US011666132B2

(12) United States Patent
Lin

(10) Patent No.: US 11,666,132 B2
(45) Date of Patent: Jun. 6, 2023

(54) CONTAINER FOR MASCARA

(71) Applicant: LIBO COSMETICS CO., LTD., Taichung (TW)

(72) Inventor: Hsiao-Yun Lin, Taichung (TW)

(73) Assignee: LIBO COSMETICS CO., LTD., Taichung (TW)

( * ) Notice: Subject to any disclaimer, the term of this patent is extended or adjusted under 35 U.S.C. 154(b) by 0 days.

(21) Appl. No.: 17/482,381

(22) Filed: Sep. 22, 2021

(65) Prior Publication Data

US 2023/0092191 A1 Mar. 23, 2023

(51) Int. Cl.

| | |
|---|---|
| ***A45D 34/04*** | (2006.01) |
| ***A45D 34/00*** | (2006.01) |
| ***A45D 40/26*** | (2006.01) |
| ***A46B 9/02*** | (2006.01) |

(52) U.S. Cl.

CPC ..... *A45D 34/046* (2013.01); *A46B 9/021* (2013.01); *A45D 34/045* (2013.01); *A45D 40/265* (2013.01); *A45D 40/267* (2013.01); *A45D 2034/002* (2013.01); *A46B 2200/1053* (2013.01)

(58) Field of Classification Search

CPC ..... A45D 34/046; A45D 2034/002; A45D 34/04; A45D 34/042; A45D 34/045; A45D 40/26; A45D 40/262; A45D 40/265; A45D 40/267

USPC ..... 401/126–130

See application file for complete search history.

(56) References Cited

U.S. PATENT DOCUMENTS

| | | | | |
|---|---|---|---|---|
| 4,289,248 A * | 9/1981 | Lynn | B65D 41/0471 215/331 |
| 5,054,946 A * | 10/1991 | Morel | A45D 34/046 401/122 |
| 6,343,887 B1 * | 2/2002 | Dumler | A45D 40/267 401/122 |
| 6,523,548 B2 * | 2/2003 | Bouix | A45D 40/265 401/122 |
| 2003/0075199 A1 * | 4/2003 | Bertazza | A45D 40/265 220/23.91 |

* cited by examiner

*Primary Examiner* — David J Walczak

(74) *Attorney, Agent, or Firm* — Bruce Stone LLP; Joseph A. Bruce

(57) ABSTRACT

A container for mascara includes a cap assembly, a bottle assembly and a brush. The bottle assembly includes a shell and a bottle. The bottle includes a section inserted in the shell in a detachable and non-rotatable manner and a neck extending from the shell. The neck includes an open end. The brush includes a handle, a rod and bristles. The handle is inserted in the cap assembly in a detachable manner and operable to close the open end of the neck of the bottle. The rod extends from the handle. The bristles are connected to the rod. The bristles and the rod are insertable in the bottle through the open end of the neck of the bottle.

14 Claims, 9 Drawing Sheets

CONTAINER FOR MASCARA

BACKGROUND OF INVENTION

1. Field of Invention

The present invention relates to mascara and, more particularly, to a container for mascara.

2. Related Prior Art

People use various kinds of cosmetics. Mascara is usually popular among ladies. Mascara is often contained in a container that includes a bottle, a cap for covering the bottle, and a brush including an end connected to the cap and another end provided with bristles. The bottle is covered by the cap so that the mascara is kept in the container. The bristles of the brush are dipped in the mascara. In use, the cap is detached from the bottle, and the brush is used to comb eyelash with some of the mascara that is carried by the bristles. An edge around an open end of the bottle is often used to scrap some mascara from the brush so that only a proper amount of mascara is left on the brush. However, this portion of the mascara soon cures and jeopardizes the carriage of a proper amount of mascara on the brush. Moreover, every time the bottle is opened, the mascara in the bottle is in contact with air and gets dried. Before the mascara is used up, it often gets too thick or sticky for proper use. In such a case, the residual mascara and the container are disposed of.

In an attempt to solve the above-mentioned problem, lotion is added into the residual mascara to render it less sticky. In an attempt to revive the portion of the mascara that cures at the edge of the bottle, face oil, artificial tear or mascara fixer liquid is added into such a portion of the mascara. However, since the contents of the face oil, artificial tear or mascara fixer liquid are different from the content of the mascara, and the addition of the face oil, artificial tear or mascara fixer liquid into the mascara can change the color and other properties of the mascara and impose risks on human health.

The present invention is therefore intended to obviate or at least alleviate the problems encountered in the prior art.

SUMMARY OF INVENTION

It is the primary objective of the present invention to provide a container for mascara that is friendly to the environment and humans.

To achieve the foregoing objective, the container includes a cap assembly, a bottle assembly and a brush. The bottle assembly includes a shell and a bottle. The bottle includes a section inserted in the shell in a detachable and non-rotatable manner and a neck extending from the shell. The neck includes an open end. The brush includes a handle, a rod and bristles. The handle is inserted in the cap assembly in a detachable manner and operable to close the open end of the neck of the bottle. The rod extends from the handle. The bristles are connected to the rod. The bristles and the rod are insertable in the bottle through the open end of the neck of the bottle.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
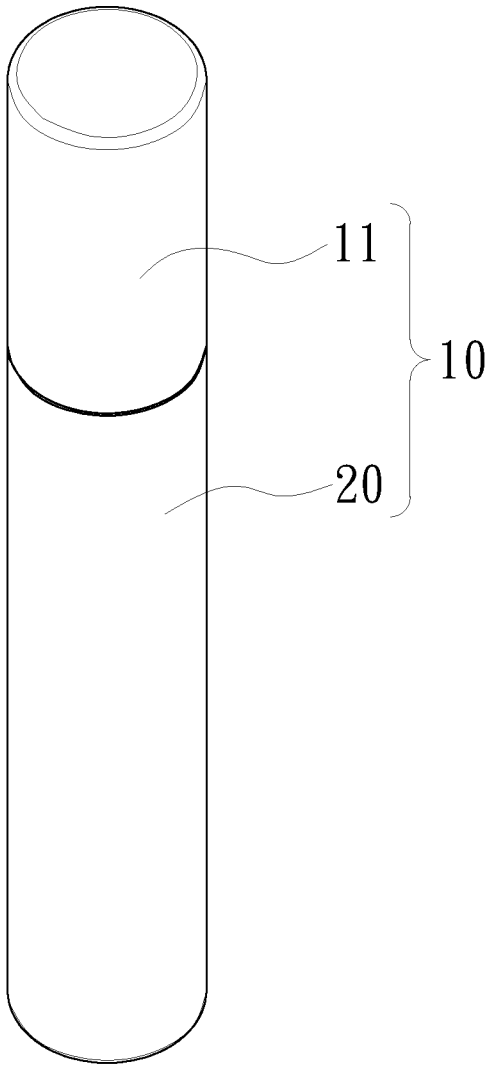
FIG. 1 is a perspective view of a container for mascara according to the preferred embodiment of the present invention.

Referring to FIG. 1, a container 10 for mascara includes a cap assembly 11 and a bottle assembly 20 according to the preferred embodiment of the present invention.

Figure 2:
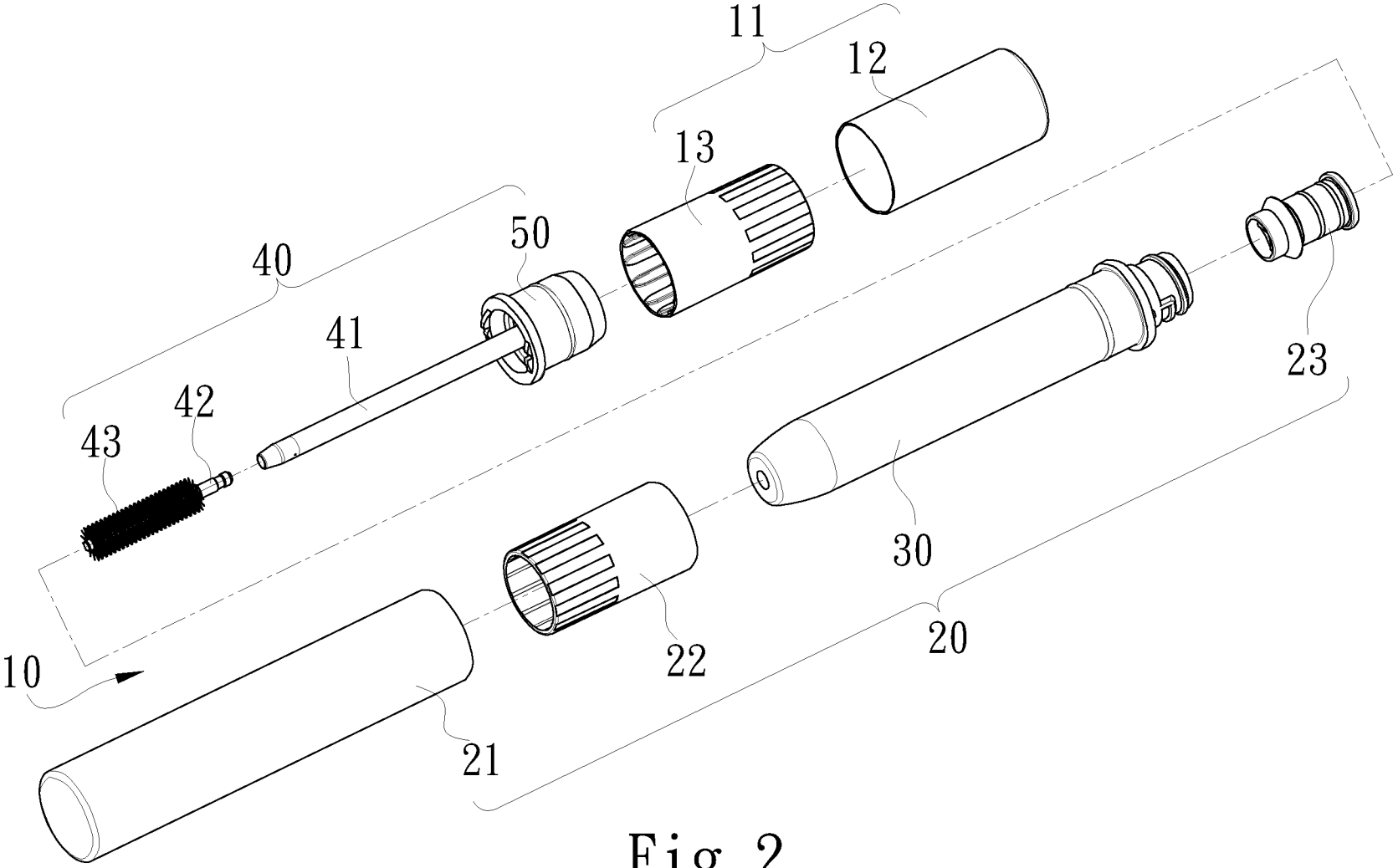
FIG. 2 is an exploded view of the container shown in FIG. 1.
Figure 3:
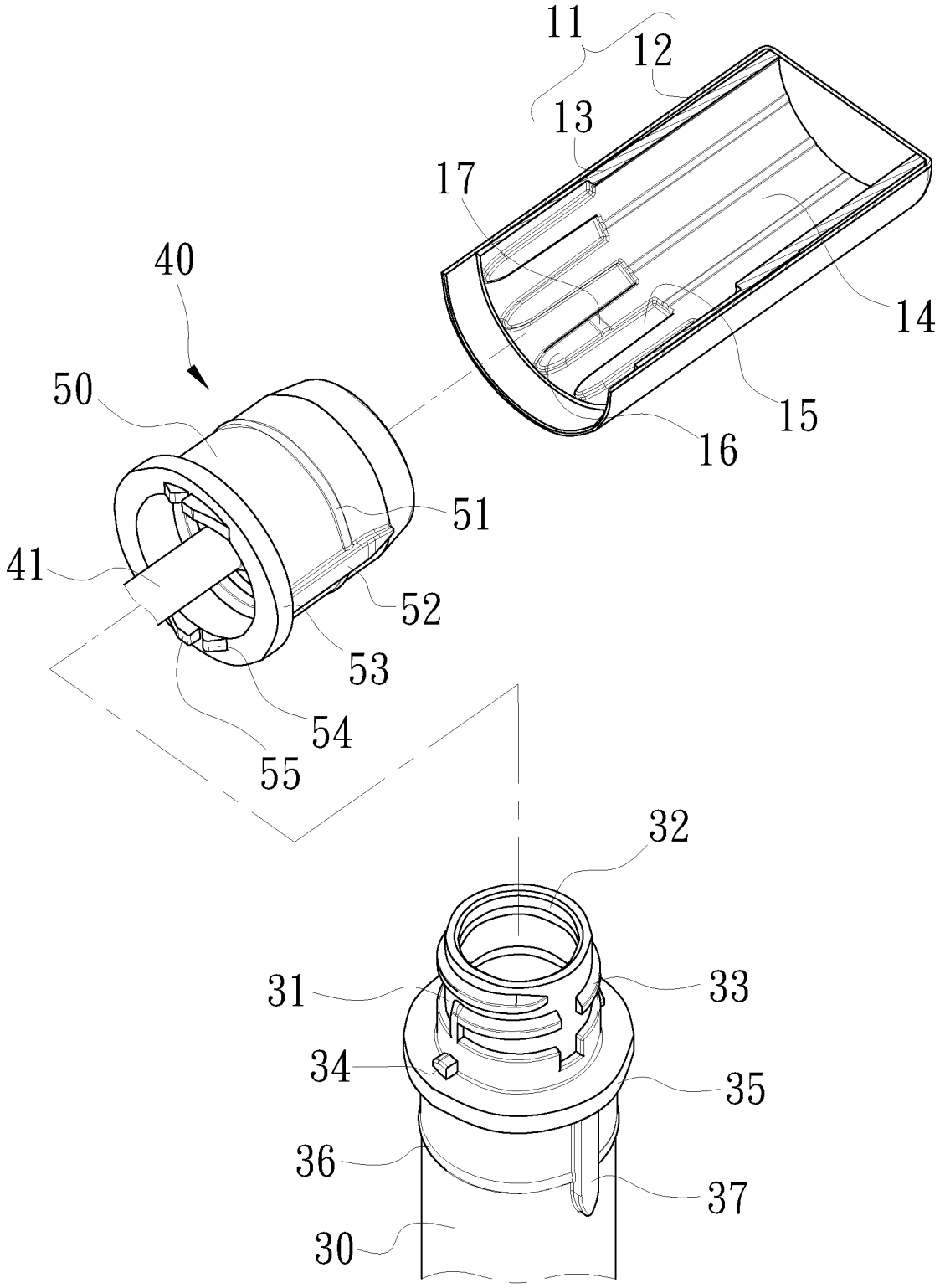
FIG. 3 is an enlarged partial view of the container shown in FIG. 2.

Referring to FIG. 2, the cap assembly 11 includes a shell 12 and a lining 13. The bottle assembly 20 includes a shell 21, a lining 22, a scrapper 23 and a bottle 30.

The container 10 further includes a brush 40 that includes a handle 50, a shank 41, a shaft 42 and bristles 43. The handle 50 is inserted in the lining 13. The shank 41 is connected to the handle 50. Preferably, the shank 41 and the handle 50 are made in one piece. The shaft 42 is connected to the shank 41 in a detachable manner. For example, a portion of the shaft 42 is inserted in a portion of the shank 41. The combination of the shaft 42 with the shank 41 can be referred to as the "rod." The bristles 43 are connected to the shaft 42.

Referring to FIGS. 3 through 6, the shell 12 is a circular shell formed with a closed end and an open end. The lining 13 is fitted in the shell 12 via the open end of the shell 12. An open end of the lining 13 is abutted against the closed end of the shell 12. The handle 50 is a circular cap formed with a closed end and an open end. The handle 50 is fitted in the lining 13 via another open end of the lining 13. That is, the lining 13 is located between the shell 12 and the handle 50.

In detail, the lining 13 includes longitudinal grooves 15 made in an internal face 14. Each of the longitudinal grooves 15 includes an open end and a closed end. The longitudinal grooves 15 are separated from one another by spacers 16. One of the spacers 16 includes a transverse ridge 17 transversely extending thereon.

The handle 50 is in the form of a cap that includes a closed end and an open end. The handle 50 further includes an annular ridge 51, a longitudinal ridge 52, a flange 53, two guiding portions 54, two blocks 55 and an internal thread 56. The internal thread 56 formed on an internal face of the handle 50. The internal thread 56 extends around the shank 41. The annular ridge 51, the longitudinal ridge 52 and the flange 53 are formed on an external face of the handle 50. The annular ridge 51 and the flange 53 extend around an axis (not shown) of the handle 50. The flange 53 extends around the open end of the handle 50. The longitudinal ridge 52 extends from the flange 53 in parallel to the axis of the handle 50. The longitudinal ridge 52 and the annular ridge 51 intersect. The guiding portions 54 and the blocks 55 extend from the flange 53 in parallel to the axis of the handle 50. Each of the blocks 55 is in the form of a wedge that includes a slope and a cliff relative to an edge of the handle 50 around the open end.

The longitudinal ridge 52 is inserted in one of the longitudinal grooves 15 through the open end of that groove 15 so that the handle 50 is smoothly inserted in the lining 13 of the cap assembly 11. The longitudinal ridge 52 is restrained between two corresponding ones of the spacers 16 so that the handle 50 is not rotatable relative to the lining 13 of the cap assembly 11. The flange 53 is abutted against the lining 13. The annular ridge 51 is forced past the transverse ridge 17 so that they are abutted against each other to keep the handle 50 in the lining 13 of the cap assembly 11. Thus, the brush 40 is connected to the cap assembly 11.

Referring to FIGS. 3 through 5, 8 and 9, the shell 21 is a circular shell formed with a closed end and an open end. The lining 22 is fitted in the shell 21 through the open end of the shell 21. The lining 22 includes longitudinal grooves 24 made in an internal face. Each of the longitudinal grooves 24 includes an open end and a closed end. The longitudinal grooves 24 are separated from one another by spacers (not numbered). One of the spacers of the shell 21 includes a transverse ridge 25 transversely extending thereon.

The bottle 30 is a circular bottle formed with an open end 32 and a closed end (not numbered). The bottle 30 further includes a neck 31, an external thread 33, two blocks 34, a flange 35, an annular ridge 36 and a longitudinal ridge 37. The neck 31 is located closer to the open end 32 than the closed end of the bottle 30. The flange 35 extends on an external face of the bottle 30 around an axis (not shown) of the bottle 30. The blocks 34 extend from the flange 35 in parallel to the axis of the bottle 30. The annular ridge 36 extends in parallel to the flange 35. The annular ridge 36 can be replaced with a C-shaped ridge in another embodiment. The longitudinal ridge 37 extends from the flange 35 in parallel to the axis of the bottle 30. The longitudinal ridge 37 intersects with the annular ridge 36.

The bottle 30 is fitted in the shell 21 through the open end of the shell 21. The longitudinal ridge 37 is inserted in one of the longitudinal grooves 24 via the open end of the groove 24 so that the bottle 30 is fitted in the shell 21 smoothly. The flange 35 is fitted in the shell 21 via the open end of the shell 21. The flange 35 is abutted against the lining 22. The annular ridge 36 is forced past the transverse ridge 25 so that they are abutted against each other to keep the bottle 30 in shell 21. The longitudinal ridge 37 is kept between two corresponding ones of the spacers of the shell 21 so that the bottle 30 is not rotatable relative to the shell 21.

In the preferred embodiment, the scrapper 23 is a circular bottle fitted in the neck 31 of the bottle 30 through the open end 32. The scrapper 23 includes annular portions 26 extending on an external face and a scraping portion 27 extending on an internal face. Top and bottom ones of the annular portions 26 are bigger than the remaining ones of the annular portions 26. The top annular portion 26 is abutted against an upper end of the neck 31. The top annular portion 26 closes a gap between an annular internal portion of the handle 50 and an annular edge extending around the open end 32 of the neck 31. The bottom annular portion 26 is abutted against a lower end of the neck 31. The remaining annular portions 26 are in contact with an internal face of the neck 31. Together, the shell 21, the lining 22, the scrapper 23 and the bottle 30 form the bottle assembly 20.

When the container 10 is not in use, the cap assembly 11 is located on the bottle assembly 20 so that the handle 50 covers the neck 31. The shank 41 is inserted in the bottle 30 via the scraping portion 27 so that the shaft 42 and the bristles 43 are dipped in mascara 28 contained in the bottle 30.

Due to the cooperation of the external thread 33 with the internal thread 56, the cap assembly 11 is rotated relative to the bottle assembly 20 in a direction so that the cap assembly 11 is attached to the bottle assembly 20. The container 10 is in the shape of a cylinder when the cap assembly 11 is attached to the bottle assembly 20 and the brush 40 is contained in the container 10.

The longitudinal ridge 52 of the handle 50 is restrained between two corresponding ones of the spacers 16 of the lining 13 so that the handle 50 is rotatable with the lining 13, which is fitted in the shell 12. Accordingly, the shaft 42 of the brush 40 is spun in the mascara 28. The longitudinal ridge 37 of the bottle 30 is kept between two corresponding ones of the spacers of the lining 22 so that the bottle 30 is only rotatable with the lining 22, which is fitted in the shell 21. The scrapper 23 closes the gap between the neck 31 of the bottle 30 and the shank 41 of the brush 40 to keep air out of the interior of the container 10.

Referring to FIGS. 2 through 5 and 7, the handle 50 closes the neck 31 of the bottle 30. The flanges 35 and 53 are in vicinity of each other. During the tightening of the handle 50 on the neck 31 of the bottle 30, each of the guiding portions 54 is smoothly moved on and then past one of the blocks 34 due to the use of the slope. Then, each of the blocks 34 is located between one of the guiding portions 54 and one of the blocks 55. The cliffs of the blocks 55 abut against the blocks 34 to keep the handle 50 on the neck 31 of the bottle 30. The blocks 55 abut against the blocks 34 to avoid excessive tightening of the handle 50 on the neck 31 of the bottle 30.

Due to the cooperation of the external thread 33 with the internal thread 56, the cap assembly 11 is rotated relative to the bottle assembly 20 in an opposite direction to move the guiding portions 54 past the blocks 34 before the cap assembly 11 is detached from the bottle assembly 20.

Then, the shaft 42 of the brush 40 is taken from the bottle assembly 20 so that the bristles 43 carry some of the mascara 28 from the bottle assembly 20. The bristles 43, which are connected to the shaft 42, which is connected to the shank 41 are scraped by the scrapper 23 so that redundant mascara 28 is scraped from the bristles 43. That is, only a proper amount of mascara 28 is carried on the bristles 43. The bristles 43 are used to brush eyelash so that the eyelash is covered by the mascara 28.

To impose an additional amount of mascara 28 on the eyelash, the shaft 42 is inserted in the bottle assembly 20 and the bristles 43 are dipped in the mascara 28 again. Then, the process described in the foregoing paragraph is repeated.

Figure 4:
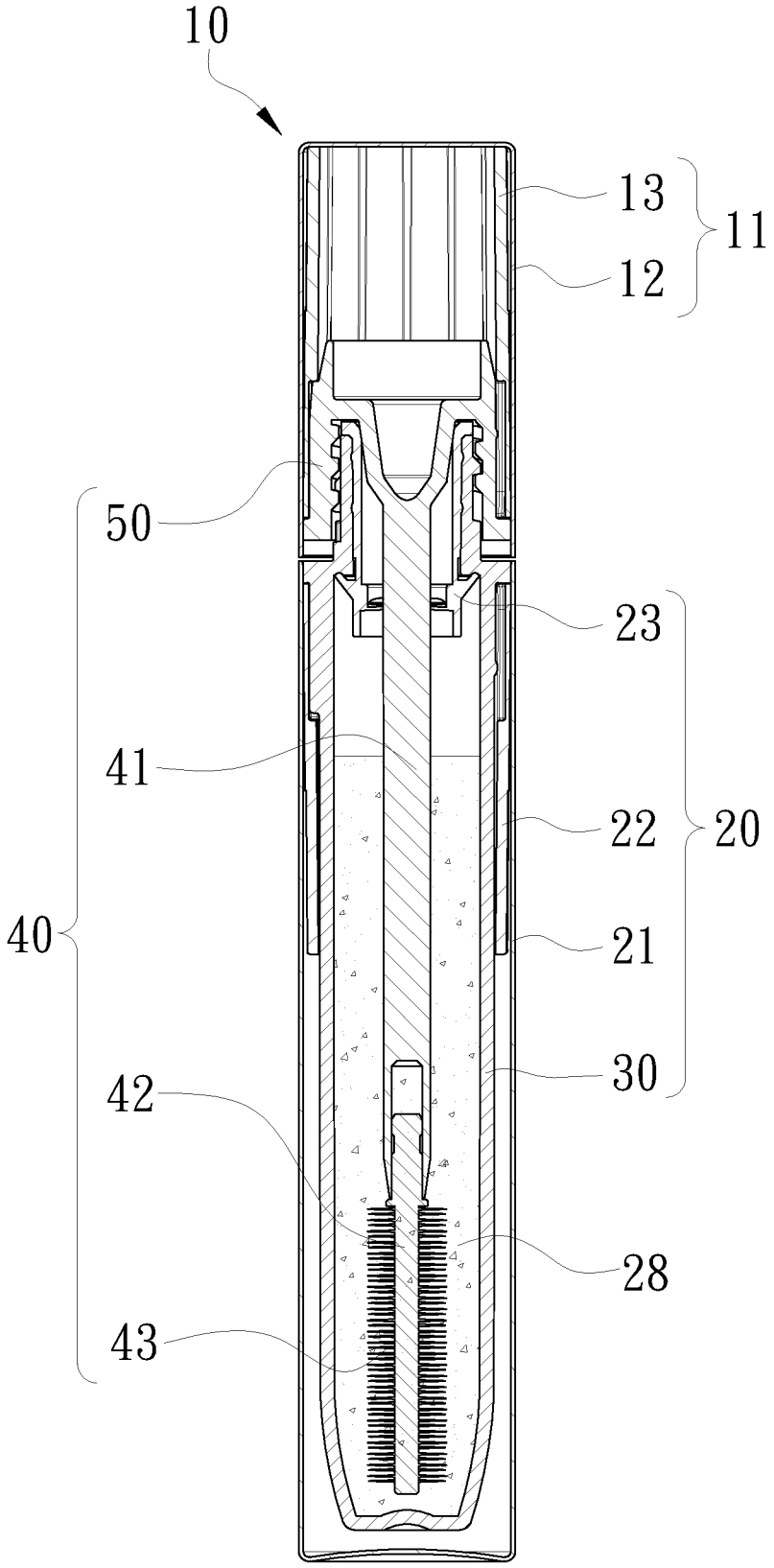
FIG. 4 is a cross-sectional view of the container shown in FIG. 1.
Figure 5:
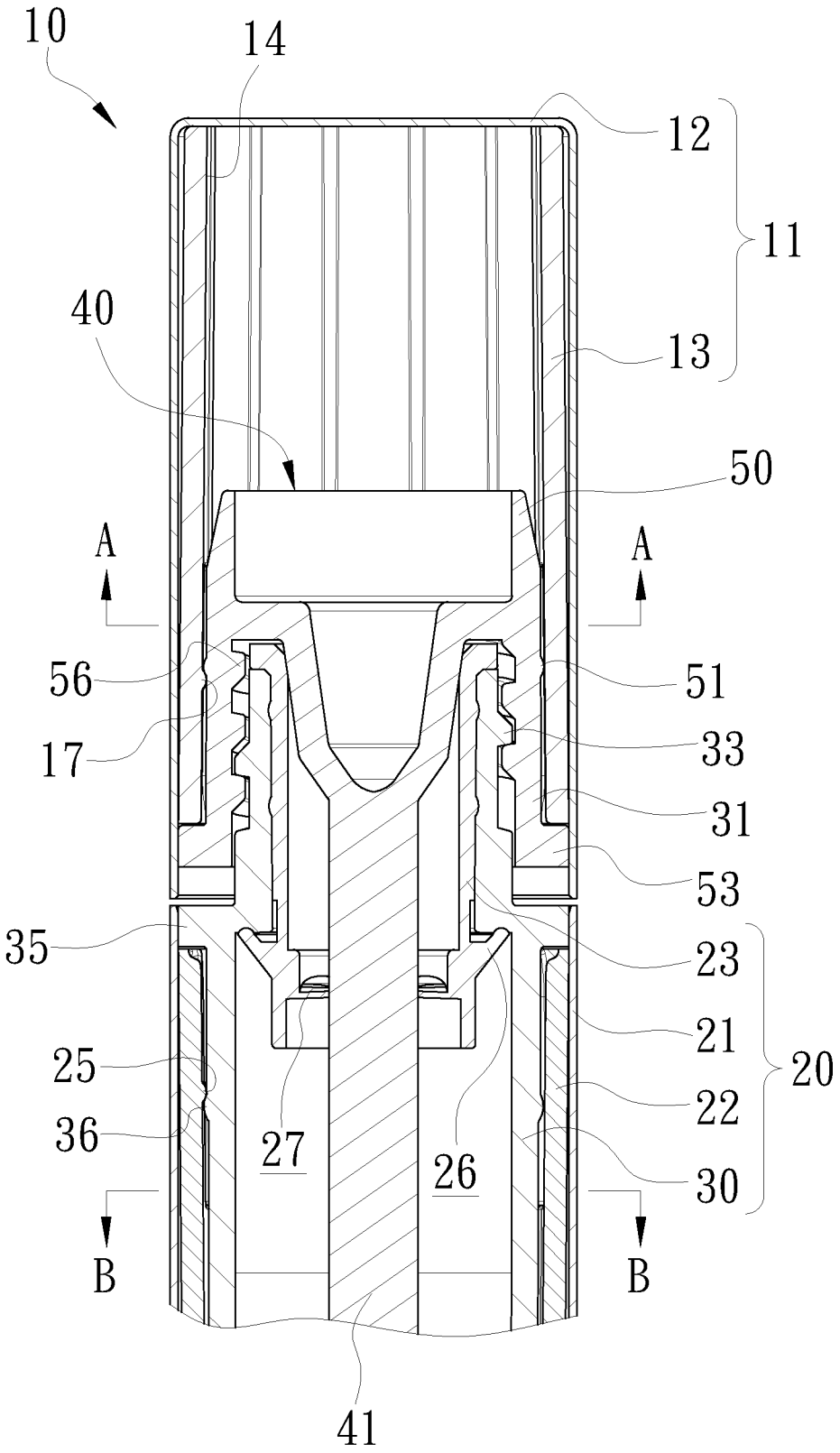
FIG. 5 is an enlarged partial view of the container shown in FIG. 4.
Figure 6:
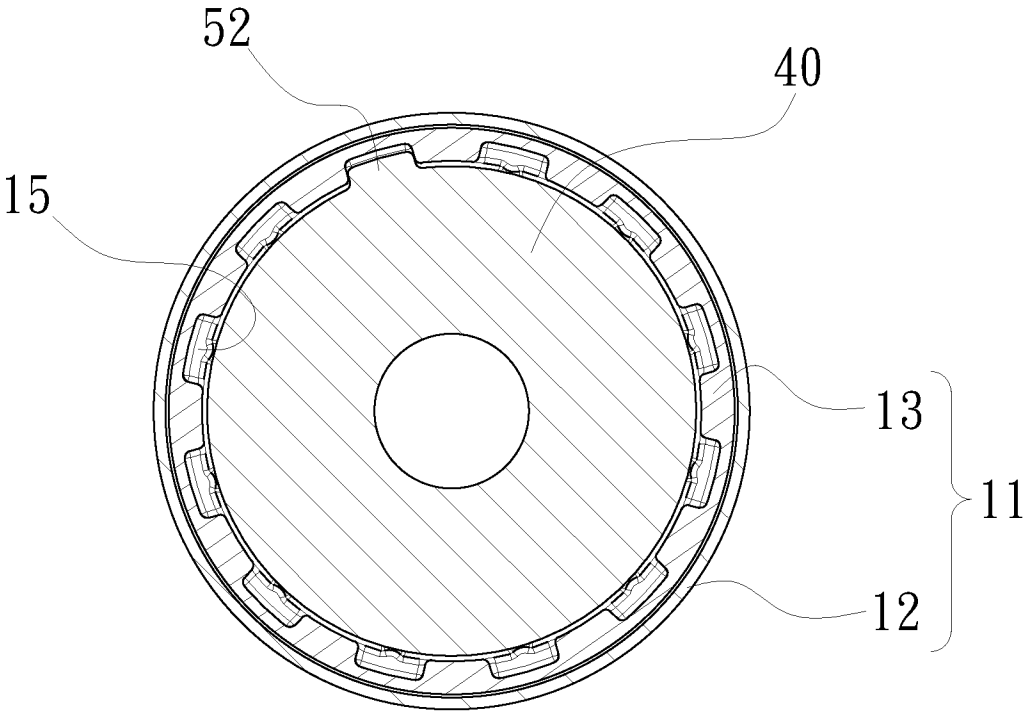
FIG. 6 is a cross-sectional view of the container taken along a line A-A shown in FIG. 5.
Figure 7:
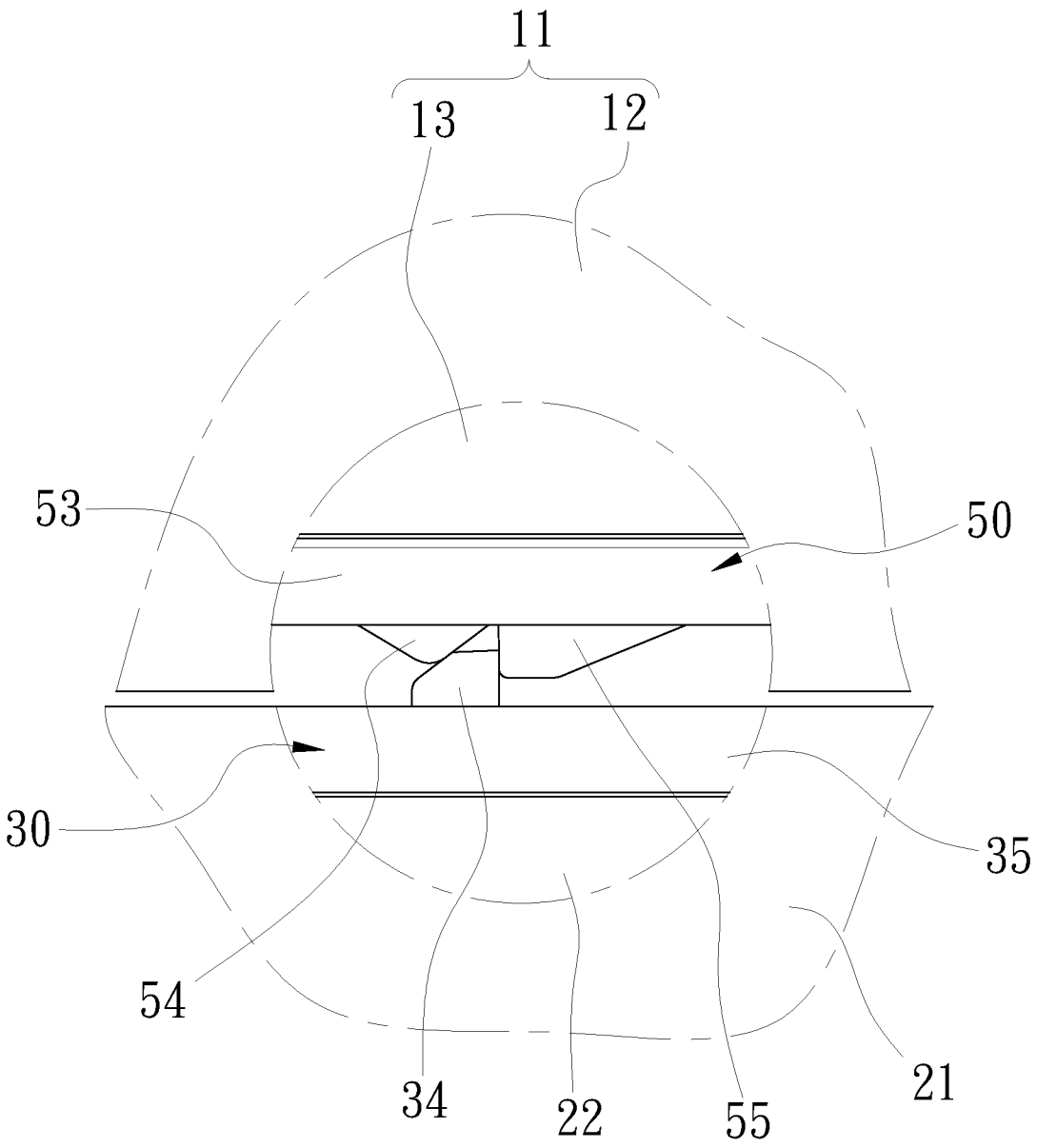
FIG. 7 is an enlarged partial view of the container shown in FIG. 1.
Figure 8:
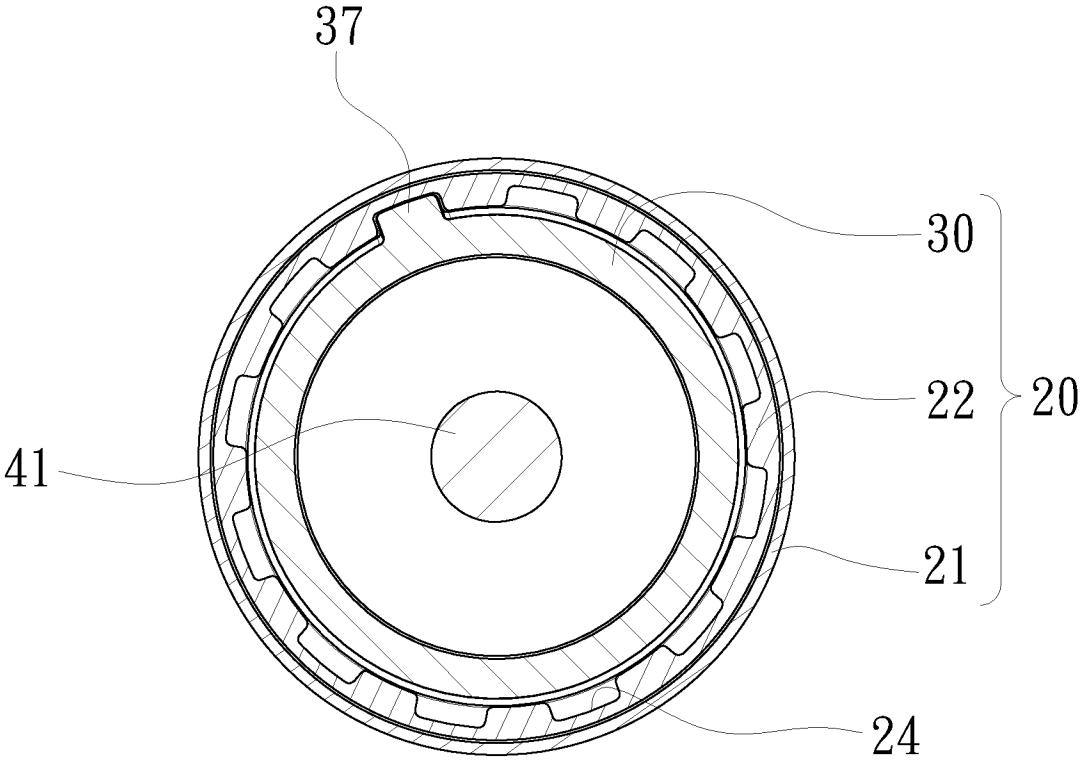
FIG. 8 is a cross-sectional view of the container taken along a line B-B shown in FIG. 5.
Figure 9:
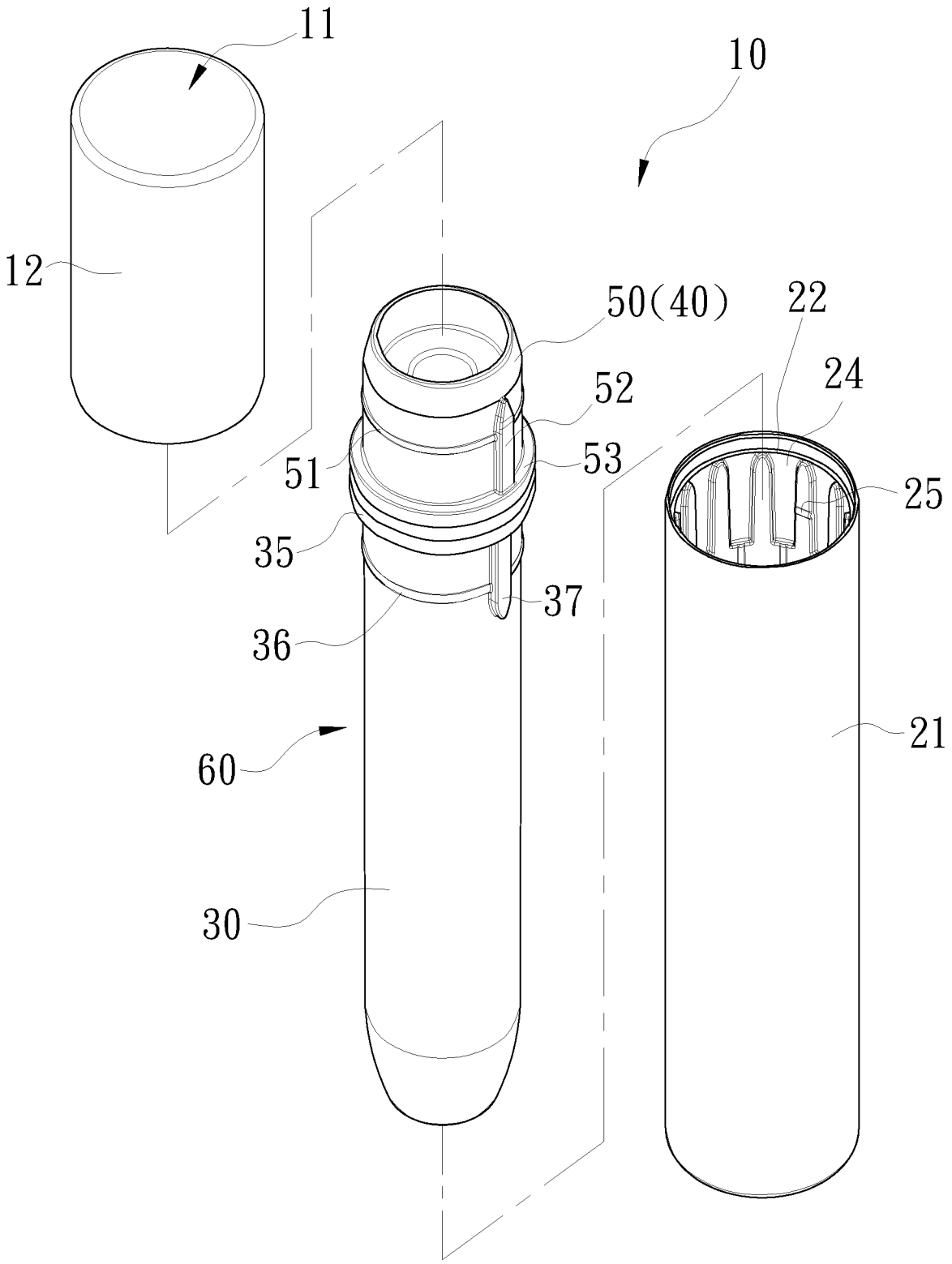
FIG. 9 is another exploded view of the container shown in FIG. 1.

When there is little mascara 28 in the bottle 30, the mascara 28 in the bottle 30 is not suitable for use, or one of the parts of the container 10 is out of order, the shell 21 and the lining 22 are detached from the bottle 30 along the axis of the bottle 30 as shown in FIG. 9 while the handle 50 is engaged with the neck 31 of the bottle 30 as shown in FIGS. 4 and 5. Together, the bottle 30, the brush 40 and the handle 50 form a refill unit 60 that can be replaced with a new one that contains new mascara 28. Hence, deteriorated mascara 28 can be replaced with new mascara 28 by replacing the refill unit 60 with a new refill unit 60, not acquiring an entire new container 10. Hence, the use of the container 10 to contain the mascara 28 is friendly to human health and the environment.

Each of the bottle 30, the brush 40 and the shaft 42 can be replaced with a new one, independent of any other component of the container 10. Hence, the use of the container 10 to contain the mascara 28 is friendly to the environment.

The abutment of the transverse ridge 17 against the annular ridge 51 is too weak to hold against the engagement of the thread 33 with the thread 56 or the friction between the lining 13 and the shell 12, thereby allowing detachment of the handle 50 from the lining 13, i.e., detachment of the brush 40 from the cap assembly 11. Similarly, the abutment of the transverse ridge 25 against the annular ridge 36 is too weak to hold against the engagement of the thread 33 with the thread 56 or the friction between the lining 22 and the shell 21 to allow detachment of the bottle 30 from the lining 22.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A container comprising:
a cap assembly;
a bottle assembly comprising:
a shell;
a lining formed with a transverse ridge and fitted in the shell so that they are not movable relative to each other; and
a bottle comprising a section inserted in the shell in a detachable and non-rotatable manner, an annular ridge for abutment against the transverse ridge of the lining of the bottle assembly to keep the bottle in the lining, and a neck extending from the shell, wherein the neck comprises an open end; and
a brush comprising:
a handle inserted in the cap assembly in a detachable manner, wherein the handle is operable to close the open end of the neck of the bottle;
a rod extending from the handle; and
bristles connected to the rod, wherein the bristles and the rod are insertable in the bottle through the open end of the neck of the bottle.

2. The container according to claim 1, wherein the neck of the bottle comprises an external thread, wherein the handle comprises an internal thread engageable with the external thread to keep the handle on the neck of the bottle.

3. The container according to claim 2, wherein the neck of the bottle comprises a block, wherein the handle comprises a block for abutment against the block of the bottle to avoid excessive tightening of the handle on the neck.

4. The container according to claim 3, wherein the handle comprises a block for abutment against the block of the neck of the bottle to prevent the handle from rotation relative to the neck of the bottle, thereby keeping the handle on the neck.

5. The container according to claim 4, wherein the block comprises a slope and a cliff at an edge around an open end of the handle, wherein the slope is smoothly movable past the block of the neck to allow the cliff to abut against the block of the neck of the bottle.

6. The container according to claim 2, wherein the neck of the bottle comprises a block, wherein the handle comprises a block for abutment against the block of the neck of the bottle to prevent the handle from rotation relative to the neck of the bottle, thereby keeping the handle on the neck.

7. The container according to claim 6, wherein the block comprises a slope and a cliff at an edge around an open end of the handle, wherein the slope is smoothly movable past the block of the neck to allow the cliff to abut against the block of the neck of the bottle.

8. The container according to claim 1, further comprising a scrapper inserted in the open end of the neck, wherein the scrapper comprises a scraping portion for scraping redundant mascara from the bristles.

9. The container for mascara according to claim 8, wherein the scrapper comprises an annular portion for closing a gap between an annular internal portion of the handle and an annular edge around the open end of the neck of the bottle.

10. The container according to claim 1, wherein the lining comprises longitudinal grooves made in an internal face, wherein the bottle comprises a longitudinal ridge inserted in one of the longitudinal grooves of the lining to prevent the bottle from rotation relative to the lining.

11. The container for mascara according to claim 1, wherein the rod comprises a shank connected to the handle and a shaft connected to the shank in a detachable manner, wherein the bristles are connected to the shaft.

12. The container for mascara according to claim 11, wherein the shank and the handle are made in one piece.

13. A container comprising:
a cap assembly comprising a shell and a lining fitted in the shell of the cap assembly so that they are not movable relative to each other, wherein the lining of the cap assembly comprises a transverse ridge;
a bottle assembly comprising:
a shell; and
a bottle comprising a section inserted in the shell in a detachable and non-rotatable manner and a neck extending from the shell, wherein the neck comprises an open end; and
a brush comprising:
a handle inserted in the cap assembly in a detachable manner and operable to close the open end of the neck of the bottle, wherein the handle comprises an annular ridge for abutment against the transverse ridge of the lining of the cap assembly, thereby keeping the handle in the lining of the cap assembly;
a rod extending from the handle; and
bristles connected to the rod, wherein the bristles and the rod are insertable in the bottle via the open end of the neck of the bottle.

14. The container according to claim 1, wherein the lining of the cap assembly comprises longitudinal grooves made in an internal face, wherein the handle comprises a longitudinal ridge inserted in one of the longitudinal grooves of the lining of the cap assembly so that they are not rotatable relative to one another.

* * * * *